United States Patent [19]

Thackrey

[11] 4,341,384

[45] Jul. 27, 1982

[54] GOLF SWING DIAGNOSTIC APPARATUS

[76] Inventor: James D. Thackrey, 13852 Dall La., Santa Ana, Calif. 92705

[21] Appl. No.: 236,706

[22] Filed: Feb. 23, 1981

[51] Int. Cl.[3] ..... A63B 69/36

[52] U.S. Cl. ..... 273/186 A

[58] Field of Search ..... 273/186 R, 186 A

[56] References Cited

U.S. PATENT DOCUMENTS

| | | | |
|---|---|---|---|
| 3,194,563 | 7/1965 | MacKniesh | 273/186 A |
| 3,601,408 | 8/1971 | Wright | 273/186 RA |
| 3,802,709 | 4/1974 | Elkins | 273/186 A |
| 4,136,387 | 1/1979 | Sullivan et al. | 273/186 A X |
| 4,137,566 | 1/1979 | Haas et al. | 273/186 RA X |
| 4,251,077 | 2/1981 | Pelz et al. | 273/186 A |
| 4,306,722 | 12/1981 | Rusnak | 273/186 R |

*Primary Examiner*—George J. Marlo

*Attorney, Agent, or Firm*—James D. Thackrey

[57] ABSTRACT

Apparatus for determining how squarely a golf club face is presented to the ball near and at the point at which the club face makes contact with the ball. Collimated light from outside the clubhead arc on the target line-of-flight strikes a reflective patch fixed to the club face. The reflected beam is picked up by sensors, each of which if struck by light switches on an adjacent marker light. Thus the path followed by the reflected beam during one stroke is marked in lights for study or playback. As few as one or as many as thousands of sensors may be used, with suitable adjustment to the optics. If the marker lights turned on are right or left of target it indicates a non-square blow. Information about clubface loft angle during the stroke is obtained from the starting and stopping point of the line of marker lights. Opening or closing the clubface near the contact point results in the line of marker lights being other than vertical. SCRs are used to turn on the marker lights so each one stays on until reset. Results may be stored and played back in more elaborate versions, but the preferred embodiment merely displays.

6 Claims, 4 Drawing Figures

GOLF SWING DIAGNOSTIC APPARATUS

BACKGROUND OF THE INVENTION

1. Field of the Invention

The invention is a diagnostic tool for teaching or practicing the game of golf, specifically for optically recording the squareness of the golf club head at the position of ball impact.

2. Description of the Prior Art

The invention partially fills the need of teaching a golfer to swing a golf club properly and effectively. A proper swing causes the club head to strike the ball squarely, at the proper elevation and at high speed. Some of the prior art is directed to the latter two factors; this invention addresses only the first factor.

Sequence photography and closed-circuit television are commonly used to record the player's motions, or less commonly the club striking the ball. The time elapsed between the stroke and the replay of it for observation is one of the problems with this approach. There are electronic stroke analyzers which record the motion of a special ball or club head containing spots, in which the angle of the clubface is obtained by triangulation of a pair of spots or stripes, using ambient light. These devices not only require complex electronics, they require equipment to be located close to the ball and so lack accurate simulation of the normal conditions of play. One device described in patent 3,194,563 uses a mirror mounted on the tip of a special club, the plane of the mirror being perpendicular to the clubface plane. As the mirror passes a concentrated beam of light angled slightly downward, the light is reflected to a photosensor which lights an indicator light. This device is also located rather close to the ball in that all components are mounted on a common base. Hence it also is unlike the normal conditions of play. Furthermore a special club is required, which being unlike the golfer's normal club will cause subtle differences in his swing. Finally, the result of the swing is displayed on the device, which is directly in front of the golfer. Psychologically a golfer is accustomed to looking toward his target to learn the result of his swing. These deficiencies are overcome in my invention.

SUMMARY

The principal object of this invention is to provide information to a golfer or his instructor as to whether, during a given swing, he is holding the clubface square to the desired ball-flight path at the moment of impact. A further object is to allow the golfer to assess whether the loft angle of the clubface (the angle in a vertical plane passing through the target and the ball) is that which he intended. A third object is to show the golfer whether the squareness with the desired ball-flight path is maintained constant, or is varied just before or just after impact. All these objects are obtained by making a displayed record, by means of marker lights, related to the squareness of the clubface.

The diagnostic tool is best understood by imaging a beam of light traveling in a vertical plane containing the target and the ball. That is, the plane is defined by the curved line of the intended ball-flight path. The beam may be inclined or horizontal, but it always passes through the ball position. It is reflected from the clubface or a reflective spot applied thereto back onto a field consisting of one or more optoelectronic sensor assemblies. Each sensor assembly struck by the reflcted beam energizes an indicator light which remains illuminated until reset. The other sensor assemblies, those not in the path swept by the reflected beam, are unaffected. Thus the field will display a lighted streak after the swing (until reset) for analysis by the golfer and his instructor. The left-to-right position of the streak indicates the squareness of the clubhead-magnified in proportion to the distance from the ball to the sensor-marker assemblies. The vertical position of the center of the streak indicates the clubface loft angle when the clubface was at the midpoint of the light beam. If a ball is in position during the stroke, the entire description given above is shifted laterally to appply to a point at the heel or toe of the club rather than at the ball center.

DESCRIPTION

Figure 1:
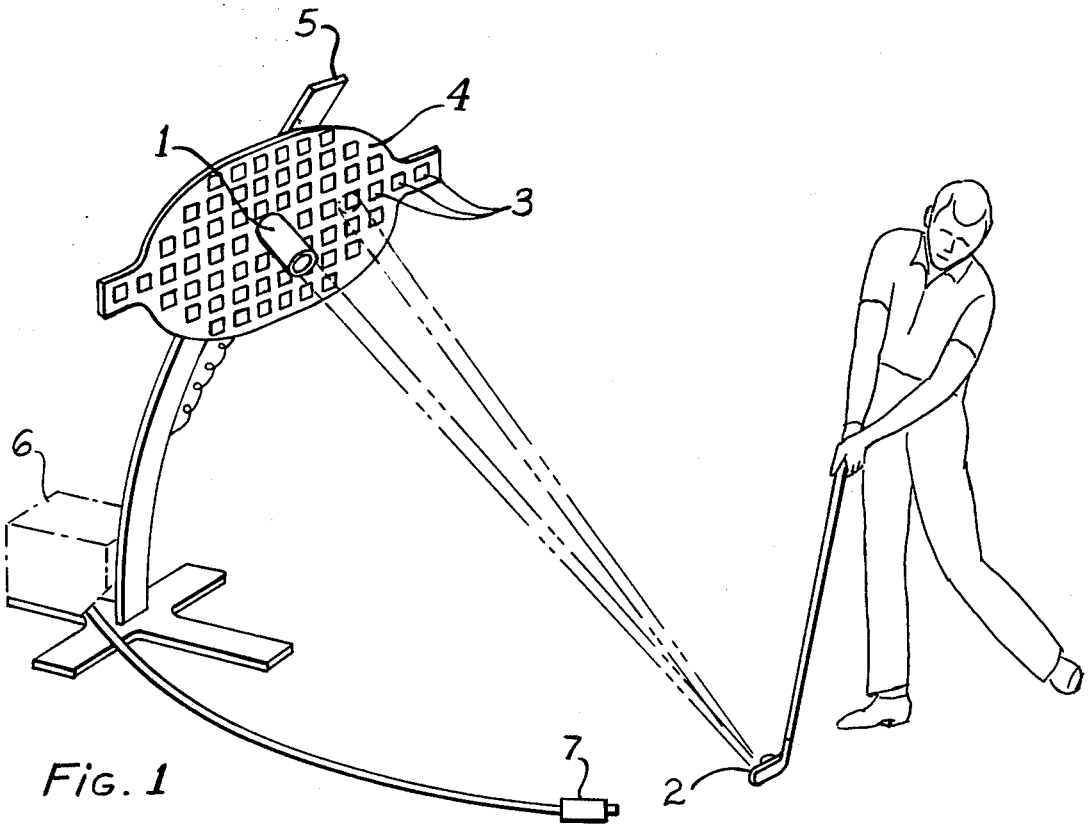
FIG. 1 is a perspective view of the preferred embodiment of the invention.

Referring to the perspective view FIG. 1, a source of electromagnetic radiation (1) projects a beam toward the position reflective surface (2) on the clubface will occupy at the time the clubface makes contact with the golf ball. This is the lowest point of the clubface's path and will be called the contact point. Source (1) may be a laser-lens combination which generates a collimated beam, or it may be an incandescent filament and lenses or mirrors so arranged to create an image of the filament at or beyond the contact point. In the figure, the source (1) projects its beam downward at the loft angle of the clubface. That is, if the clubface were held in contact with the ball as it would be in a perfect swing, the central ray from source (1) would be reflected back upon itself, neither higher nor lower, left or right.

The only essential requirement for items (1) and (2) is that substantially all the reflective surface receive equal illumination, so the brightness of the source "looking up" the reflected beam appears the same regardless of which portion of the reflective surface is being examined. This will be further discussed in connection with FIG. 4.

Reflective surface (2) may be the protective plating on the golf club's face, or a reflective material fixed to the golf club's face with adhesive, or a reflective material with a backing of crushable foam plastic. In the latter case, prior to making his swing the golfer will have crushed the backing so as to make the reflective surface lie in the same plane as the portion of the club face with which the ball is to be struck. Thus the same diagnostic tool can be used with woods—which do not have a plane club face—as with irons which do.

As the golf club face is swung into and through the contact point electromagnetic radiation such as light will be reflected from the reflective surface. The reflected radiation will strike the field (4) having a multiplicity of sensor-marker assemblies (3). These assemblies may be arranged in various ways, the preferred embodiment being shown in FIG. 1. One horizontal row of left-to-right sensor-marker assemblies is at the level of the light source. Successively shorter rows are centered left-to-right on the light source, and located successively higher and lower as shown in FIG. 1. Enough such shorter rows are provided to cause the height of the sensor-marker array, near the center, to be greater than will receive adequate radiation to turn on during a swing. The elevation of the turned-on line of marker lights gives a rough measure of the loft angle during the string, which an observer may compare to the marker light elevation with the clubface resting against the ball and the golfers body stationary but in the position which it should have at the moment of impact. Thus, if his hands were lagging from the desired position the clubface would have more loft than was desired and the set of marker lights turned on would be higher than desired as well as being left or right if the clubface was closed or open (for a right-handed golfer). Moreover if the clubface were being opened or closed during the swing near the contact point the display of marker lights would be non-vertical.

Item (5) of FIG. 1 is a frame on which a field or array of sensor-marker assemblies and the light source are mounted. In the preferred embodiment the track, to which the field (4) and source (1) are adjustably clamped, is curved so the point at which a practice ball is placed does not change as various clubs of various loft angles are used.

Item (6) is a housing to contain power supplies, Item (7) is a reset switch shown on a cord, which interrupts power to the SCR-marker light circuit, thereby resetting the apparatus after the stroke has been analyzed to the satisfaction of the golfer. Although Item 6 is shown as a thumb-operated normally closed switch, other arrangements such as a foot-operated switch or a switch which resets the apparatus photoelectrically during the golfer's backswing would be obvious to one skilled in the art.

Figure 2:
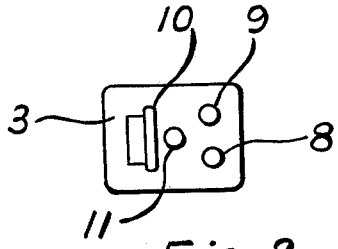
FIG. 2 is an enlarged plan view of one of the sensor-marker assemblies.

FIG. 2 shows a typical sensor-marker assembly (3). Light-sensitive transistor (8) has its emitter connected to bleed resistor (10) and to the gate of silicon controlled resistor (SCR) Item (11). Marker light (9) is located physically close or adjacent to light sensitive transistor (8).

FIG. (3) is a circuit diagram of a sensor-marker assembly. It shows graphically the connections described above. When reset switch (7) is in its normally closed position, increased radiation striking transistor (8) increases the current it transmits. The voltage at the junction increases as more current is forced through bleed resistor (10), until voltage is high enough to trigger the gate terminal of SCR (11), turn it on and thus turn on marker light (9). If a fixed resistor is used at (10) the radiation required is fixed; if a variable resistor is used as shown the turn-on radiation required can be regulated somewhat to allow for manufacturing variations in the transistor (8) and SCR (11). Once any SCR is triggered into conducting across its main terminals, it continues to conduct indefinitely so the marker light will remain on until current is interrupted by reset switch (7).

Figure 4:
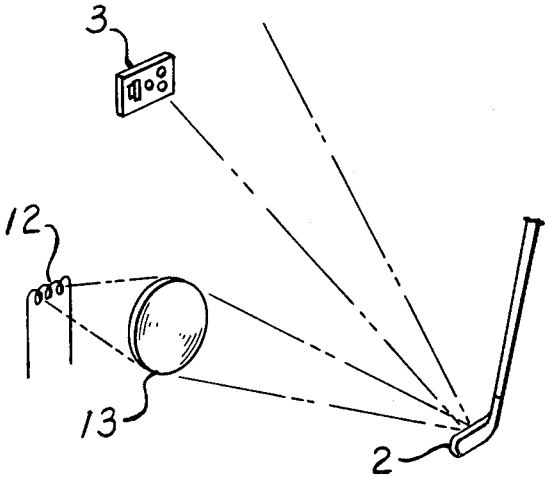
FIG. 4 is a partial perspective view of an alternate arrangement having only one sensor assembly.
Figure 3:
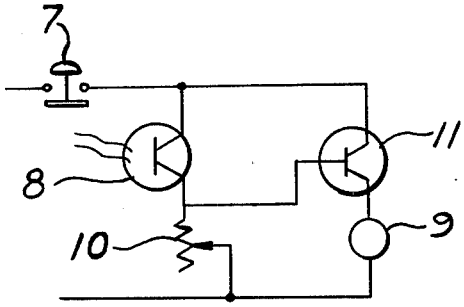
FIG. 3 is a typical electrical schematic diagram, which might be used for a sensor-marker assembly.

FIG. 4 shows an alternate embodiment in which a single sensor-marker assembly is used. The operation is exactly the same as FIG. 1, but whereas the beam of light from light source 1 is sufficiently intense to turn on a sensor-marker assembly only over a narrow cross-section, in FIG. 4 a wide cross-section of sufficient intensity is desired. Incandescent filament (12) is placed at one conjugate point of focusing means (13), shown as a lens, though a concave mirror would work as well. The other conjugate point, the point where an enlarged image of the filament is formed, is the contact point where the clubface strikes the ball. In this embodiment focusing means (13) is several inches across, so that "looking up" the reflected beam from a point well to one side of its center, an observer or transistor (8) could see the full brightness of the filament at every small region of the reflective surface (2), or substantially so. Eventually as the observer moves further off the center of the reflected beam, the reflective surface appears less than fully covered by the filament, the radiant energy reaching the observer or transistor (8) decreases correspondingly, and a point is reached which is far enough off center that the energy drops below that required to trigger the gate of SCR (11) and turn on the marker light. If focusing means (13) is six inches in diameter, and the contact point is equidistant from lens and sensor-marker assembly, full radiant power exists in the reflected beam center, and for somewhat less than three inches off-center. The sensor-marker assembly will be triggered at a somewhat greater distance than three inches off-square. Although the embodiment of FIG. 4 requires that source and sensor-marker assembly be one above the other so both can be in the working plane, a single sensor-marker suffices to give a fairly precise measure of the squareness of the clubhead. The working plane is a plane parallel to the plane containing the intended ball-flight path, but displaced by the distance on the clubface between the sweet spot and the reflective surface (2).

There are various modifications of form the invention can take which would be readily apparent to one skilled in the art. The light source (1) can be fixed or adjustable in height and direction subject only to passing adjacent to the ball position. Other optoelectronic devices which react to the electromagnetic radiation may be used, such as light activated SCRs or integrated circuits. Protective bars or transparent shields may be used to protect the sensor-marker field (4) when the invention is being used with regulation balls, as on a driving range. The directional sensitivity of optical trigger devices may be increased using hoods for outdoor use or where stray light is a problem. Even apparatus containing microprocessors capable of recording and recalling on command the results of a series of swings, so as to display the consistency of a golfers swing, are within the scope in that such apparatus would not necessarily require further use of the inventive faculty.

This invention having been described in its preferred embodiment, it is clear that it is susceptible to numerous modifications and embodiments within the ability of those skilled in the art and without the exercise of the inventive faculty. Accordingly the scope of this invention is defined by the scope of the following claims.

I claim:

1. Apparatus to be used in evaluating the swinging of a golf club with regard to the squareness of the golf club's face to the intended ball-flight path at the point in the golf club swing at which the club face makes contact with the ball, comprising a source of electromagnetic radiation, and reflective material backed with adhesive so as to be affixed temporarily to any golf club's face, and a multiplicity of sensor-marker assemblies each of which comprises a sensor assembly which reacts to the electromagnetic radiation from said source by closing an electrical circuit; and a marker light adjacent to said sensor-marker assembly and disposed to be switched on when the electrical circuit is closed, in which radiation from said source must be reflected from said reflective material to reach any of said multiplicity of sensor-marker assemblies, whereby during a single golf swing only certain ones of said sensor-marker assemblies receive radiation and these certain ones may be identified as having received radiation by their having closed the electrical circuit and switched on their associated marker light, the location of the switched-on marker lights with respect to the intended ball-flight path existing after a swing being immediately visible to an observer whereby the observer can evaluate the squareness of the golf club face during the swing.

2. Apparatus for use with a golf club for displaying the squareness of the golf club's face to a working plane parallel to the plane containing the intended ball-flight path during that portion of a golf club swing when the club face is near the contact point with the ball, comprising an incandescent filament located in the working plane, and focusing means having conjugate points, one conjugate point being at said filament and the other being the contact point, and a reflective surface fixed to the golf club's face, and a light-sensitive transistor located in the working plane, and a silicone controlled rectifier (SCR) having one gate terminal and two main terminals, the gate terminal being connected to said light-sensitive transistor and the main terminals of said SCR being in a series circuit with a marker light adjacent to said light-sensitive transistor, whereby at the contact point of the swing radiation from said incandescent filament is caused by said focusing means to fall on said reflective surface and, if the club face is square to the intended path, will be reflected to fall on said light-sensitive transistor and so trigger the gate of said SCR which conducts and turns on said marker light, the illumination or non-illumination of said marker light constituting a display showing squareness or non-squareness respectively of the golf club face at the contact point.

3. Apparatus for obtaining and displaying information about loft angle and squareness of a golf club's face to a working plane parallel to the plane containing the intended ball-flight path during that portion of a golf club swing when the club face is at or near the contact point with the ball, comprising an incandescent filament located in the working plane, and focusing means having conjugate points, one conjugate point being at said filament and the other being at the contact point, and a plurality of light-sensitive transistors located on the same side of the club face as said filament, on a field transverse to the working plane, each said transistor having associated with it a silicon-controlled rectifier (SCR) having one gate terminal and two main terminals, the gate terminal being connected to said light-sensitive transistor and the main terminals being in a series circuit with a marker light adjacent to said light-sensitive transistor, whereby at the contact point of the swing radiation from said filament is caused by said focusing means to reflect from the club face as the club face passes through the conjugate point and after reflection to proceed toward said light-sensitive transistors and possibly strike some of them, triggering the gate of their associated SCRs and turning on their associated marker lights whereby the pattern of turned-on marker lights forms a display from which information about the loft angle and squareness at and near the contact point is preserved for diagnosis and study.

4. Apparatus to be used when a golf club is swung for practice to sense and display the squareness of the club face to the desired ball-flight path and simultaneously the loft angle of the clubface when the club head is near the point where the clubface impacts a practice ball, comprising a source of electromagnetic radiation formed into a beam and directed downward at the loft angle desired of the clubface at the moment of contact with the practice ball, and a multiplicity of sensor-marker assemblies located adjacent to each other to form a field around said source of electromagnetic radiation, each of which sensor-marker assemblies comprises a light-sensitive transistor which transmits an electric signal when struck by electromagnetic radiation reflected from the clubface, and an SCR whose gate voltage is controlled by the signal from said light sensitive transistor, and a marker light connected in series with the main terminals of said SCR, in which electromagnetic radiation from said source does not reach said sensor-marker assemblies until it has been reflected from the clubface hence only such light-sensitive transistors as are in the path of the reflected beam will transmit an adequate voltage to the gate terminal of their associated SCR to turn on their associated marker light, whereby a display of illuminated marker lights exists until reset among the multiplicity of sensor-marker assemblies, the left-to-right and the vertical position of illuminated marker lights enabling the squareness of the clubface to the desired ball-flight path and the loft angle near the point where the club impacts the practice ball, respectively, to be determined.

5. Apparatus for displaying the accuracy with which a golfer swings a golf club against a practice ball, through creating a display of lights by which squareness and loft angle of the clubface at the point in the swing at which ball contact is made may be diagnosed, comprising an incandescent filament, and focusing means having two conjugate points, the first at said filament and the second on the unused portion of the clubface as contact is made with the practice ball, both said filament and said focusing means being adjustably mounted, and a frame on which said filament and focusing means are mounted, said frame being curved about the second conjugate point so the second conjugate point remains essentially stationary when said filament and focusing means are moved along said frame for adjustment, and a multiplicity of sensor-marker assemblies arranged in a field surrounding said filament and focusing means, the field being substantially perpendicular to the line between the conjugate points, each sensor-marker assembly comprising a light-sensitive transistor, and a resistor, and a silicon controlled rectifier (SCR) whose gate and said resistor are both connected to said light-sensitive transistor, said resistor being selected to control the sensitivity of said sensor-marker assembly to illumination such that when sufficient illumination is present the trigger voltage of the gate of said SCR is reached, and a marker light in series with the main terminals of said SCR, there being in series connection with each said sensor-marker assemblies a common element, a normally-closed momentary contact switch which may be momentarily opened to reset the apparatus, operation of the apparatus being to first adjust the line between conjugate points to be square with the clubface when the clubface is held as desired against the practice ball, and then to move the club, reset the marker lights and execute the practice swing, whereupon light from the filament will be reflected from the clubface into the field of sensor-marker assemblies, and only such sensor-marker assemblies as receive reflected light will turn on, enabling the squareness and actual loft angle of the clubface at the point of contact with the practice ball to be determined from the pattern of illuminated marker lights.

6. An electronic method of depicting in lights the squareness with the intended ball-flight path and the clubface loft angle near the point of impact with a practice golf ball, so as to diagnose a golfer's swinging of a golf club, comprising shining a beam of light from an elevated position in the direction of the intended ball-flight path downward to an area adjacent to the practice ball, through which area a part of the face of the golf club must pass if the swing is properly executed, and sensing the location of light reflcted from the club's face using light-sensitive transistors, a multiplicity of individual light-sensitive transistors being distributed transversely to the beam of light, and electronically switching on an associated marker light adjacent to each of the light-sensitive transistors which is struck by the reflected light and turning off all the marker lights after the diagnosis of the swing's squareness and loft has been made in preparation for the next swing.

* * * * *